United States Patent [19]

Brown, Jr. et al.

[11] 4,090,315

[45] May 23, 1978

[54] DISPLAY WITH MOVABLE INDICIA

[75] Inventors: Asa V. Brown, Jr., Royston; James Marshall Suttles, Elberton, both of Ga.

[73] Assignee: Hopeman Brothers, Inc., New York, N.Y.

[21] Appl. No.: 780,677

[22] Filed: Mar. 23, 1977

[51] Int. Cl.[2] ..... G09F 11/24

[52] U.S. Cl. ..... 40/518

[58] Field of Search ..... 40/86, 86 A, 125 H, 40/125 K

[56] References Cited

U.S. PATENT DOCUMENTS

| | | | |
|---|---|---|---|
| 439,009 | 10/1890 | Jenks | 40/86 R |
| 1,547,033 | 7/1925 | Crawford | 40/86 R |
| 1,860,772 | 5/1932 | Dorion | 40/86 R |
| 1,896,935 | 2/1933 | Bloomfield et al. | 40/86 R |
| 3,160,974 | 12/1964 | Carleton | 40/125 K |
| 3,364,960 | 1/1972 | Don Carlos | 40/125 K |

*Primary Examiner*—Louis G. Mancene
*Assistant Examiner*—Wenceslao J. Contreras
*Attorney, Agent, or Firm*—Smith, Harding, Earley & Follmer

[57] ABSTRACT

A support for use in a movable indicia display comprises a series of at least three substantially identical panels arranged in edge-to-edge adjoining relationship in a plane, each panel having a first guide channel formed along one edge and located on one side of the plane and a second guide channel formed along the opposite edge and located on the other side of the plane, the non-adjacent guide channels of adjoining panels facing each other to provide a guide for the opposite edges of indicia-carrying means located therebetween.

14 Claims, 10 Drawing Figures

DISPLAY WITH MOVABLE INDICIA

BRIEF SUMMARY OF THE INVENTION

This invention relates to displays with movable indicia and more particularly to a support structure for such displays. The invention has utility in displays such as gasoline price signs, scoreboards for baseball and other sports, flight number signs in airport baggage claim areas, signs used in accouncing airline, railroad or bus departures, and safety signs in industrial plants (i.e. signs displaying the number of days since the last lost-time accident). The invention is especially useful where information is to be displayed on both sides of a signboard.

Polyester sheets such as Mylar (polyethylene terephthalate) can be heat-treated to produce tightly self-coiling rolls. These rolls provide an ideal indicia-carrying material for movable-indicia displays, as their self-coiling characteristic eliminates the need for take-up reels, cranks and other feeding mechanisms. A polyester sheet can be arranged so that rolls are formed at both ends, with the section extending between the rolls providing the display. In order to change the information displayed, it is only necessary to push on the section between the rolls manually, causing the sheet to feed from one roll to the other. Where multiple-digit numerical information is to be displayed any number of sheets can be arranged in side-by-side relationship, each sheet displaying only one digit at any particular time.

In displays of this type, it is necessary to provide a support for the polyester rolls and to provide guidance either for the sections of the sheets extending between the rolls, or for the rolls themselves. In the support in accordance with the invention, a series of at least three panels is provided, the panels being arranged in adjoining edge-to-edge relationship in a plane. Any greater number of panels may be used, depending on the number of separate sheets in the display.

If the sections of the sheets extending between the rolls are to be guided, each panel is provided with a first guide channel formed along one edge and located on one side of the plane, and a second guide channel formed along the opposite edge and located on the other side of the plane. The non-adjacent guide channels of adjoining panels face each other to provide a guide for the opposite edges of an indicia-carrying sheet carried between them.

If the rolls themselves are to be guided, then each panel is provided with a first flange formed along one edge and extending perpendicularly from said one edge on one side of the plane, and a second flange formed along the opposite edge and extending perpendicularly from said opposite edge on the other side of the plane. The non-adjacent flanges of adjoining panels provide guide means for the opposite ends of rolls of indicia-carrying material located between them.

Whether the support guides the sheets, the rolls, or both, the panels of the support can be substantially identical, with the result that there is a significant saving in manufacturing costs. The use of identical panels also simplifies assembly of the display, which is an important advantage especially where the display is shipped as a kit and assembled by the customer.

In the case of gasoline price signs used in service stations, it is usually necessary to display three digits: tenths of a dollar, cents, and tenths of a cent. The tenths of a cent are usually represented by a smaller sized digit, and presently in many service stations this digit is permanently a nine. It is not at all necessary that it be a nine, however, and the invention enables the retailer to display other digits in the tenths of a cent position. While the higher order digits are displayed on full-sized sheets each having a width approximately that of two panels, tenths of a cent can be displayed on a narrower sheet having half the width of a full-sized sheet, i.e. the width of just one panel. Where the narrower sheet is used, an auxiliary guide is located adjacent the outer edge of one of the end panels in the series. It cooperates with the guide channel formed along the inner edge of the end panel to provide guidance for the narrower sheet. Either as an alternative or as an adjunct to the aforementioned auxiliary guide, there may also be provided an auxiliary guide for the rolls, located adjacent the outer edge of an end panel and cooperating with a flange formed along the inner edge of the end panel.

Where the gasoline price sign is to be viewed from both sides, auxiliary guides are provided along the outer edges of both end panels in the display. An odd number of panels is used in the display (ordinarily five panels), and very little panel material is wasted as practically the entire panel area is covered by the indicia-carrying sheets.

In a preferred embodiment of the invention roll retainers are used to hold the auxiliary guides in fixed relationship to each other. The roll retainers, which support the rolls against radial movement, extend across the series of panels and are secured to the auxiliary guides on both sides of the series of panels. The use of the roll retainers as structural elements in this manner produces a significant simplification in the overall support.

Another significant structural simplification results from the use of the roll retainers to clamp the ends of the panels to hold the panels in a common plane. A rectangular series of panels has two edges, each of which comprises, in common, one edge of each of the panels in the series. First and second roll retainers located along and adjacent one of these common edges on opposite sides of the plane of panels are used to clamp the common edge, thereby keeping the edges of the panels which constitute this common edge in line with one another. Third and fourth roll retainers can be used in a similar manner to clamp the opposite common edge of the series of panels.

The invention provides a unique support structure satisfying one or more of the following primary objectives. First, the support is inexpensive to manufacture as it utilizes only a small number of different parts, which, except for fasteners, can be sheet metal. Secondly, since it requires few fasteners and many of its parts are identical, it is easily and rapidly assembled and can therefore be shipped in kit form. Third, the same panels can be used to construct a display having any desired number of sheets; i.e. panels identical to those used in a three-digit gasoline price sign can be used in a fifteen inning baseball scoreboard. Still further objects will be apparent from the following detailed description when read in conjunction with the drawings.

DETAILED DESCRIPTION

Figure 1:
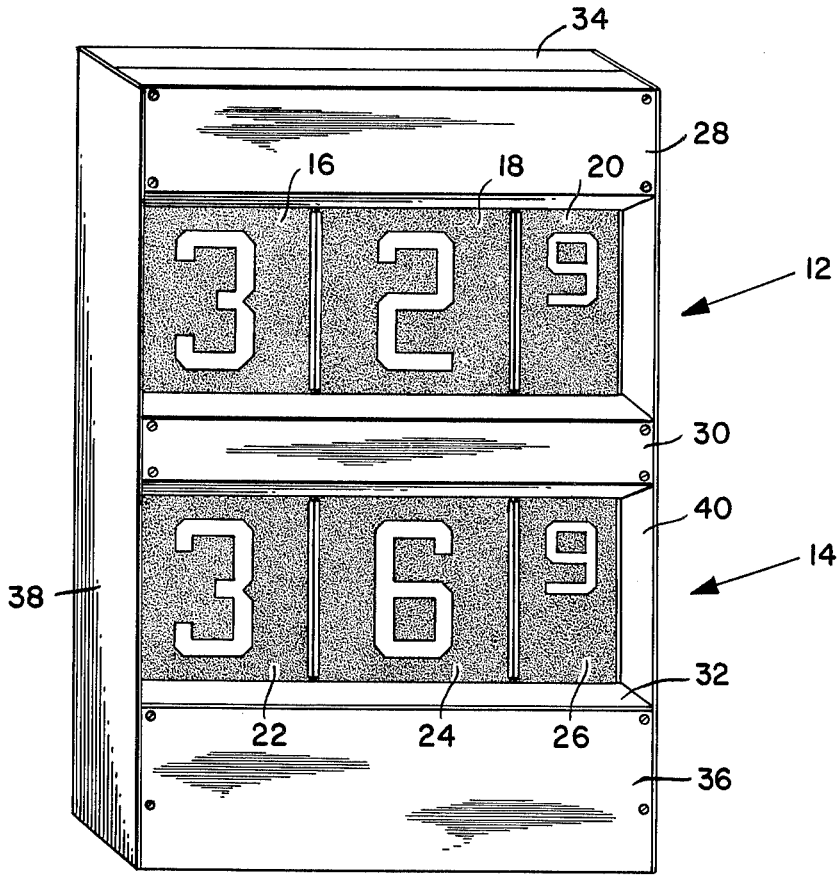
FIG. 1 is an oblique perspective view of an assembled gasoline price sign in accordance with the invention.

While the support in accordance with this invention may take many alternative forms, it will now be described with reference to a three-digit, two-sided, two-row gasoline price sign, as shown in FIG. 1. On the side of the display which is shown in FIG. 1, there are two rows 12 and 14 of numbers, row 12 typically displaying the price of regular gasoline, and row 14 displaying the price of premium gasoline. Row 12 comprises three sheets 16, 18 and 20 of polyester film, each sheet displaying a single digit. Sheets 16 and 18, displaying respectively tenths of a dollar and cents are equal in width, while sheet 20, displaying tenths of a cent, is approximately half the width of either of sheets 16 and 18. Sheets 22, 24 and 26 in row 14 are similarly related to each other in size, and each displays only one digit at a time.

The price sign is designed to have an identical display on the opposite side (not shown) and two additional rows, each having three sheets of indicia-carrying material are provided on the opposite side.

Each of the sheets extends from an upper roll to a lower roll. The upper rolls of sheets 16, 18 and 20 are situated and hidden behind roll retainer 28, located at the upper end of the display. The lower rolls of sheets 16, 18 and 20 are situated and hidden behind intermediate roll retainer 30, which also retains the upper rolls of sheets 22, 24 and 26. The lower rolls of sheets 22, 24 and 26 are situated and hidden behind a lowermost roll retainer 32, which is identical in configuration to retainer 28. Additional roll retainers are provided on the opposite side, corresponding respectively to retainers 28, 30 and 32. Only the uppermost roll retainer 34 is visible in FIG. 1.

The assembly of FIG. 1 also comprises a base 36, which supports the assembly, and which also hides much of roll retainer 32. Side panels 38 and 40 are provided at the sides of the display.

Figure 4:
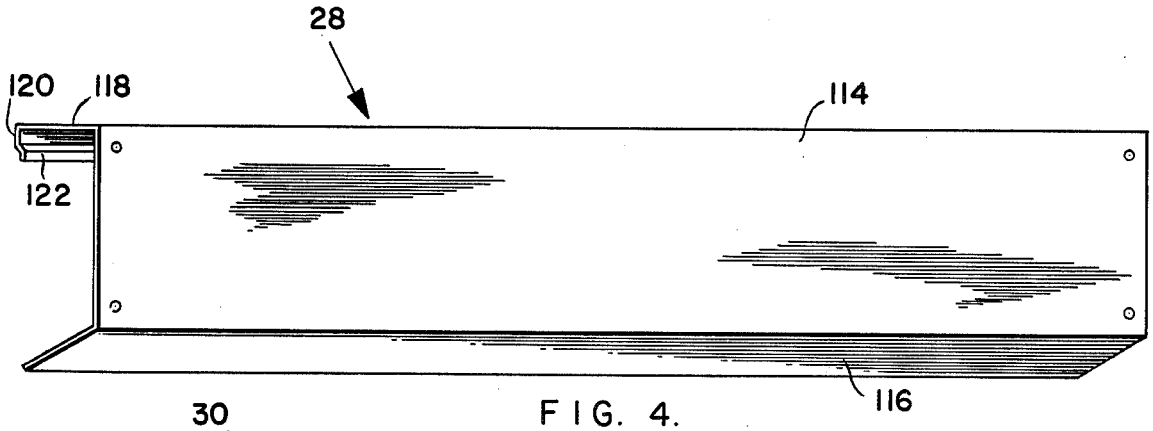
FIG. 4 is a three-quarter elevation of one of the roll retainers used to clamp the ends of the panels corresponding to the one shown in FIG. 3.
Figure 5:
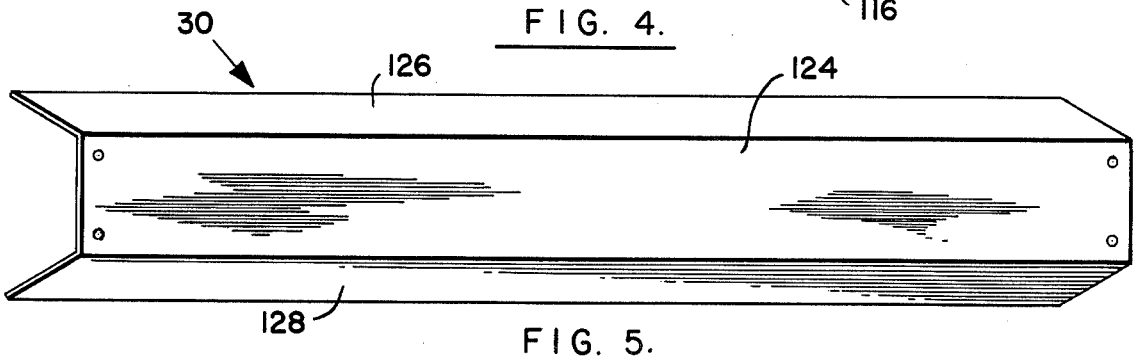
FIG. 5 is a three-quarter elevation of an intermediate roll retainer of the kind used on multiple-row displays.
Figure 2:
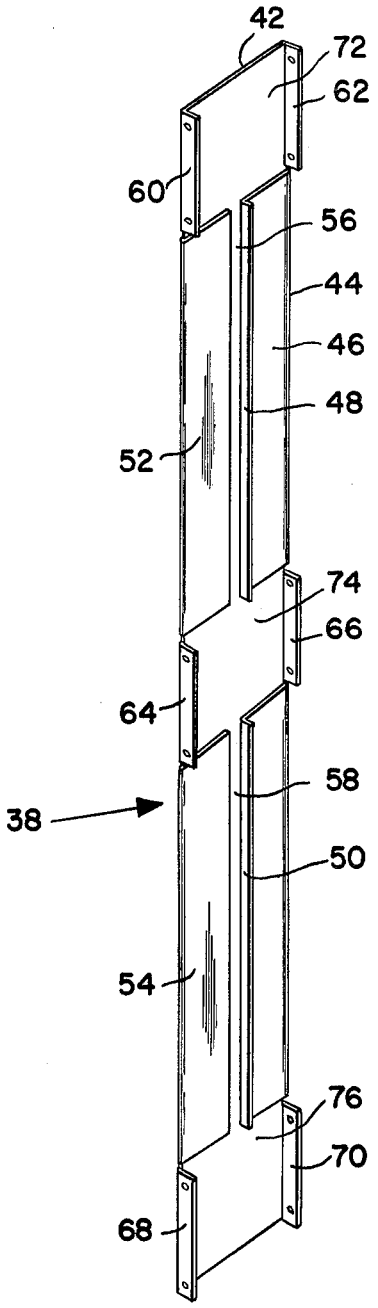
FIG. 2 is an oblique perspective of one of the two vertical side panels of the assembly of FIG. 1, showing auxiliary guide means for the indicia-carrying sheets and for the rolls, and also showing flanges for attachment of the roll retainers to the vertical side panel.
Figure 3:
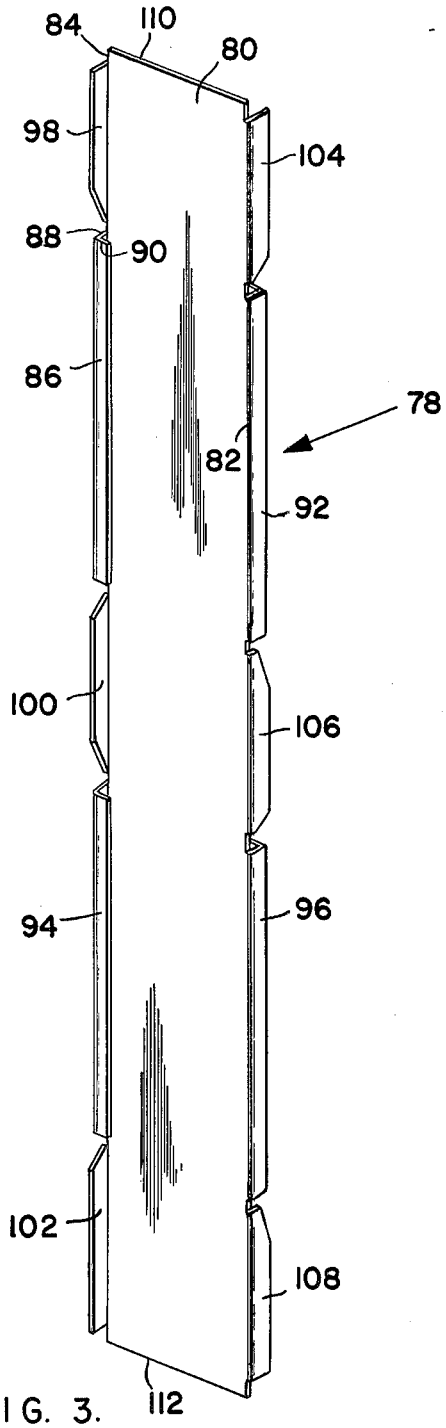
FIG. 3 is an oblique perspective of one of the five identical panels of the assembly of FIG. 1, this drawing illustrating the guide channels and roll-guiding flanges formed along the opposite long edges of the panel.

The basic parts of the support shown in FIG. 1 are: two side panels of the type shown in FIG. 2; five panels of the type shown in FIG. 3; four roll retainers of the type shown in FIG. 4; and two intermediate roll retainers of the type shown in FIG. 5.

Referring to FIG. 2, side panel 38 is formed from a sheet metal stamping, and comprises a generally rectangular elongated sheet 42, having various elements formed along its long edges by folding. One such element, which is secured to sheet 42 through fold 44, comprises a rectangular element 46, which extends in parallel to sheet 42, and terminates in a flange 48. Flange 48 is perpendicular to sheet 42 and is located at a distance from fold 44 which is slightly less than half the width of sheet 42. The purpose of flange 48 is to provide an auxiliary guide for the outer edge of a narrow polyester sheet in the sign. A similar flange is formed at 50 on the lower part of side panel 38.

Rectangular elements 52 and 54 are formed along the opposite vertical edge of sheet 42. These elements are similar to element 46, except for the fact that they do not terminate in a perpendicular flange. Elements 52 and 54 extend almost halfway across sheet 42, and are spaced from flanges 48 and 50 respectively so that spaces 56 and 58 are provided to receive the edges of the end panels in the series of edge-to-edge related panels. Elements 52 and 54 act as reinforcements for the side panels.

Side panel 38 is also provided along its long vertical edges with six perpendicular flanges 60, 62, 64, 66, 68 and 70. These flanges serve to connect the roll retainers to the side panels.

Surfaces 72, 74 and 76 of sheet 42 are inwardly facing when the display is fully assembled, and these surfaces provide auxiliary support for ends of indicia-carrying rolls.

FIG. 3 shows a sheet metal panel 78, which is one of the five substantially identical panels in the series. Panel 78 comprises a generally elongated rectangular sheet 80 having generally parallel long edges 82 and 84. A first guide channel 86 is formed along edge 84. Guide channel 86 preferably comprises a first element 88 which extends in a direction perpendicular to the plane of sheet 80, and a second element 90, which is parallel to and spaced from sheet 80. Guide channel 86 is located on the near side of the plane of sheet 80.

A guide channel 92, similar to guide channel 86, is formed along edge 82, but is situated on the opposite side of the plane of sheet 80. The elongated openings of guide channels 86 and 92 face inwardly toward the center of the panel.

A second guide channel 94, similar to guide channel 86, is located along the lower portion of edge 84 on the near side of the plane of sheet 80, and another guide channel 96 is located along the lower portion of edge 82 on the far side of the plane.

A first flange 98 extends perpendicularly from edge 84 on the near side of the plane of sheet 80 near the upper end of the panel. An intermediate flange 100 extends perpendicularly from edge 84 at the mid-portion of the panel, and a third flange 102 is provided at the lower end of edge 84. All three flanges, 98, 100 and 102 are perpendicular to the plane of sheet 80, and extend in the same direction. Similar flanges 104, 106 and 108, are located along edge 82, and extend perpendicularly from edge 82 toward the far side of the panel.

It will be observed that panel 78 is symmetrical in two respects: first, each part above the midpoint has a corresponding part at the same distance below the midpoint; and secondly, the panel can be rotated 180° about a vertical axis without changing its appearance.

The upper edge 110 of sheet 80 extends upwardly for a short distance beyond the upper edges of flanges 98 and 104. Likewise, the lower edge 112 of sheet 80 extends a short distance below the lower edges of flanges 102 and 108.

FIG. 4 shows roll retainer 28, one of four identical roll retainers in the sign. Retainer 28 is formed by folding a single rectangular sheet of metal so that it has a generally rectangular front portion 114, an oblique retaining portion 116, a horizontal portion 118, a vertically extending flange portion 120, and a panel clamping portion 122. Panel clamping portion 122 is connected to flange portion 120, and is parallel to portion 120, but closer than portion 120 to front portion 114.

The intermediate roll retainer 30, shown in FIG. 5, is used on multiple-row displays, and comprises a generally rectangular front portion 124, and oblique upper and lower retaining portions 126 and 128.

The manner in which the parts shown in FIGS. 2–5 are assembled is illustrated in FIGS. 6–9.

Figure 7:
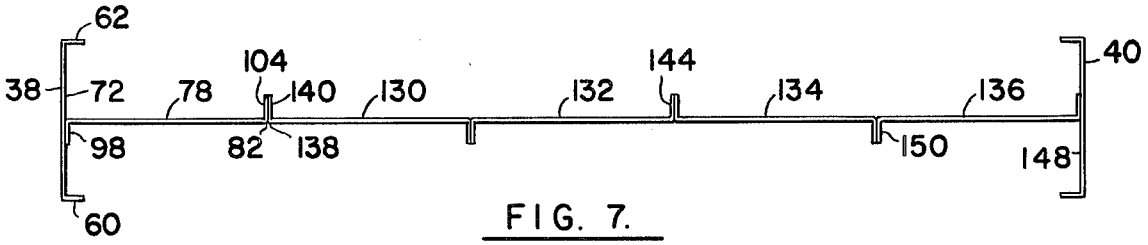
FIG. 7 is a horizontal section as viewed through the plane 7—7 of FIG. 6.
Figure 8:
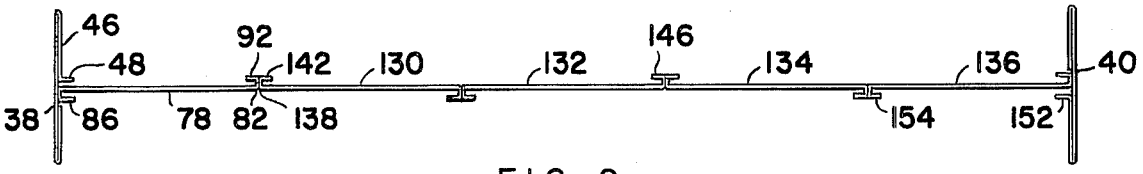
FIG. 8 is a horizontal section as viewed through the plane 8—8 of FIG. 6.
Figure 6:
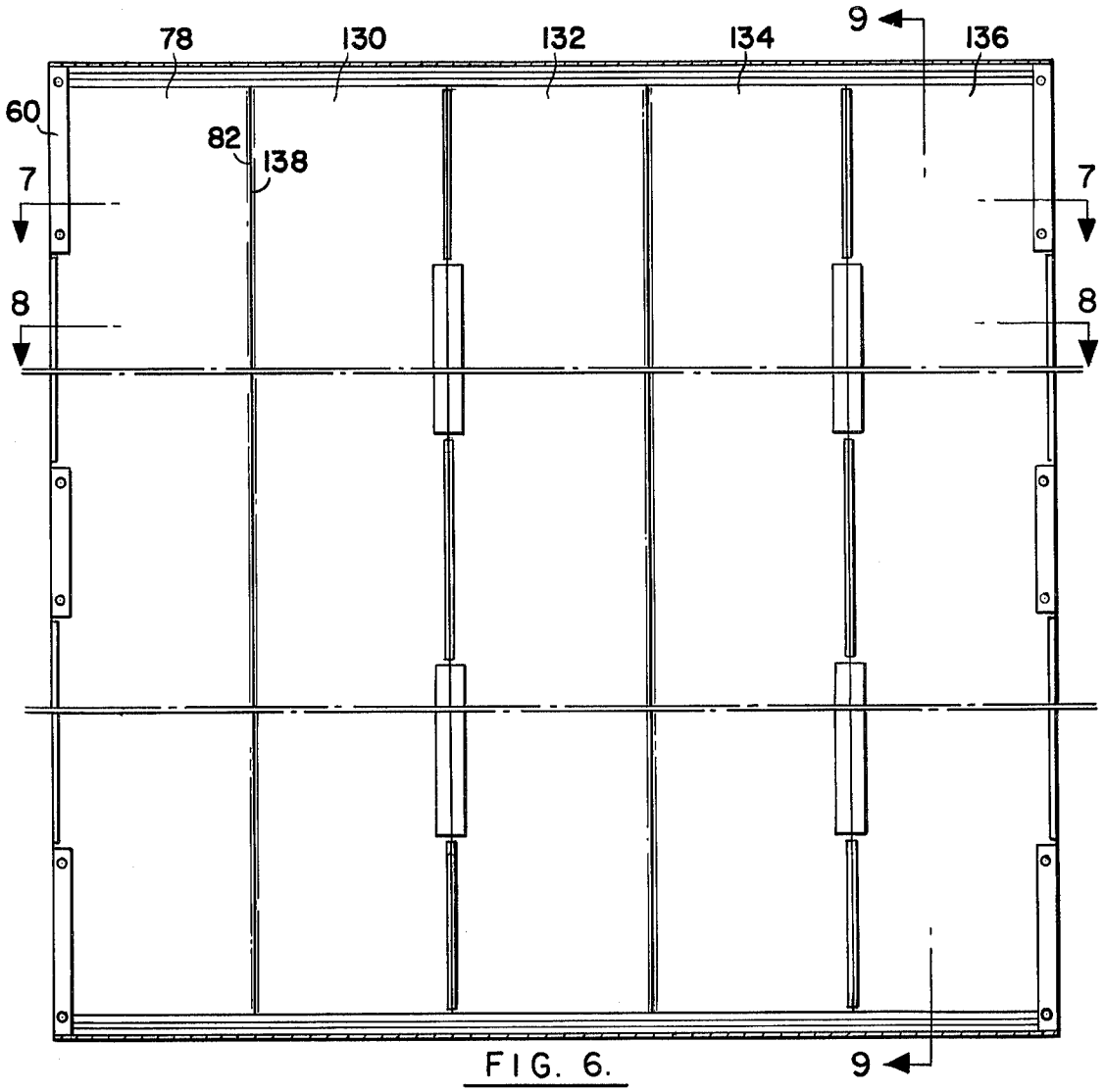
FIG. 6 is an elevational view (partly broken away) of an assembly of panels of the kind shown in FIG. 3 together with a pair of side panels of the kind shown in FIG. 2.

As shown in FIGS. 6, 7 and 8, panel 78 is one in a series of five substantially identical panels 78, 130, 132, 134 and 136, arranged in edge-to-edge adjoining relationship in a plane. Edge 82 of panel 78 adjoins one of the long, vertically-extending edges 138 of panel 130, and the adjacent vertical edges of the remaining adjoining panels are similarly aligned with each other so that the panels are arranged in a plane. In FIG. 7, it will be noted that flange 104 of panel 78 extends in the same direction as flange 140 of panel 130. The remaining adjacent flanges likewise extend in the same direction as each other.

Likewise, in FIG. 8, it will be observed that guide channel 92 of panel 78 is located on the same side of the series of panels as guide channel 142 of panel 130. Similarly, the guide channels in any adjacent pair are located on the same side of the series of panels.

From FIG. 7, it will be appreciated that the non-adjacent flanges 140 and 144 of adjoining panels 130 and 132 extend in the same direction as each other so that they are capable of providing guidance for the opposite ends of a roll located between them. Considering any two adjoining panels in the series, the non-adjacent flanges will be seen to extend in the same direction as each other to provide guidance for a roll located between them.

Referring to FIG. 8, the non-adjacent guide channels 142 and 146 on panels 130 and 132 are located on the same side of the series of panels as each other, and their openings face each other to provide a guide for the opposite edges of an indicia-carrying sheet located between them. Similarly, for any two adjoining panels in the series, the non-adjacent guide channels face each other to provide a guide for the opposite edges of an indicia carrying sheet located between them.

The structures in FIGS. 7 and 8 will be seen to provide guidance for four full-sized rolls and four full-sized sheets, each of the rolls and each of the sheets having a width approximately equivalent to the width of two panels. In addition, referring to FIG. 7, it will be seen that inwardly facing surface 72 of side panel 38, together with flange 104 provides guidance for a narrower roll, having approximately half the width of a full-sized roll. Similarly, inwardly facing surface 148 of side panel 40 cooperates with flange 150 to provide guidance for a narrow roll on the opposite side of the series of panels.

In FIG. 8, flange 48 on side panel 38 acts as an auxiliary guide, and cooperates with channel 92 on panel 78 to provide guidance for a narrow-width sheet. Similarly, flange 152 on the opposite side panel 40 cooperates with channel 154 on panel 136 to guide another narrow sheet.

With the structures shown in FIGS. 6–8, two large sheets, and one small sheet are accommodated in each row on both sides of the display, and substantially all of the panel area which would otherwise be exposed is covered by the indicia-carrying sheets.

Figure 9:
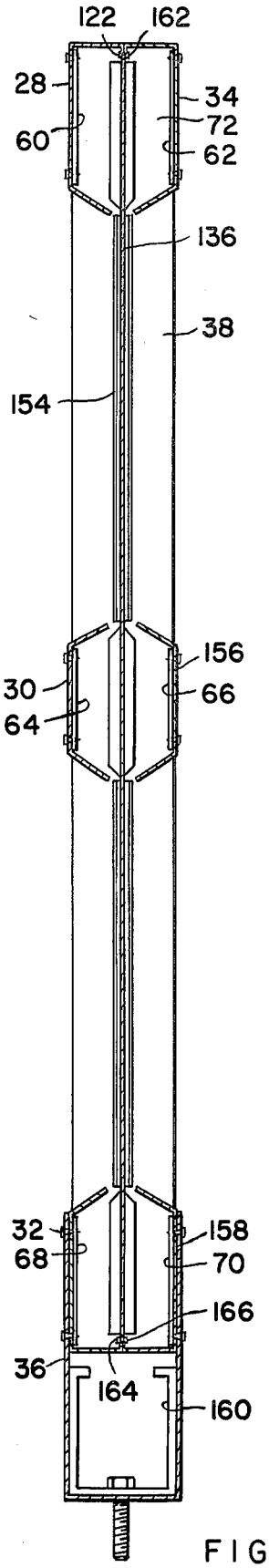
FIG. 9 is a vertical section as viewed through the plane 9—9 of FIG. 6.

As shown in FIG. 9, roll retainer 28 is secured to flange 60 of side panel 38, and roll retainer 34 is similarly secured to flange 62. Intermediate roll retainer 30 is secured to flange 64, and intermediate roll retainer 156 on the opposite side of the display is secured to flange 66. At the bottom of the display, roll retainer 32 is secured to flange 68, and roll retainer 158 is secured to flange 70. The sheet metal screws which secure the bottom roll retainers to the flanges also pass through holes in base 36, which is a U-shaped channel. All six of the roll retainers are secured at their opposite ends to flanges on side panel 40, which is located opposite side panel 38. The roll retainers, by being secured to the side panels, serve to secure the auxiliary roll guides and the auxiliary sheet guiding means in fixed relationship to each other and to the series of panels. Conversely, the side panels provide support for the roll retainers.

Base 36 may be used in several ways. In the embodiment shown, it is reinforced by another U-shaped channel 160, which can be bolted to a supporting arm or to a concrete base in a service station. The U-shaped base channel 36 can be alternatively secured to the upper part of the display to provide for suspension of the display. Of course, a wide variety of alternative supporting schemes are possible.

FIG. 9 also illustrates the manner in which the uppermost and lowermost roll retainers clamp the panels of the series to maintain them in a common plane. Roll retainers 28 and 34 are arranged in back-to-back relationship at the upper end of the display, and panel clamping portion 122 on retainer 28 cooperates with a corresponding panel clamping portion 162 on retainer 34 to clamp all of the panels between them to maintain the uppermost edges of the panels in line with one another. In a similar manner, panel clamping portions 164 and 166, located respectively on retainers 32 and 158, clamp the lower edges of the panels, so that all four roll retainers 28, 34, 32 and 158 serve to maintain all of the panels of the series in a common plane. It will be apparent from the foregoing that the side panels support the roll retainers, the roll retainers in turn support the side panels and thus support the auxiliary guiding means, and that the roll retainers also support the series of panels and maintain them in alignment in a common plane, all of which provides an exceedingly simple structure, requiring only a small number of fasteners.

Figure 10:
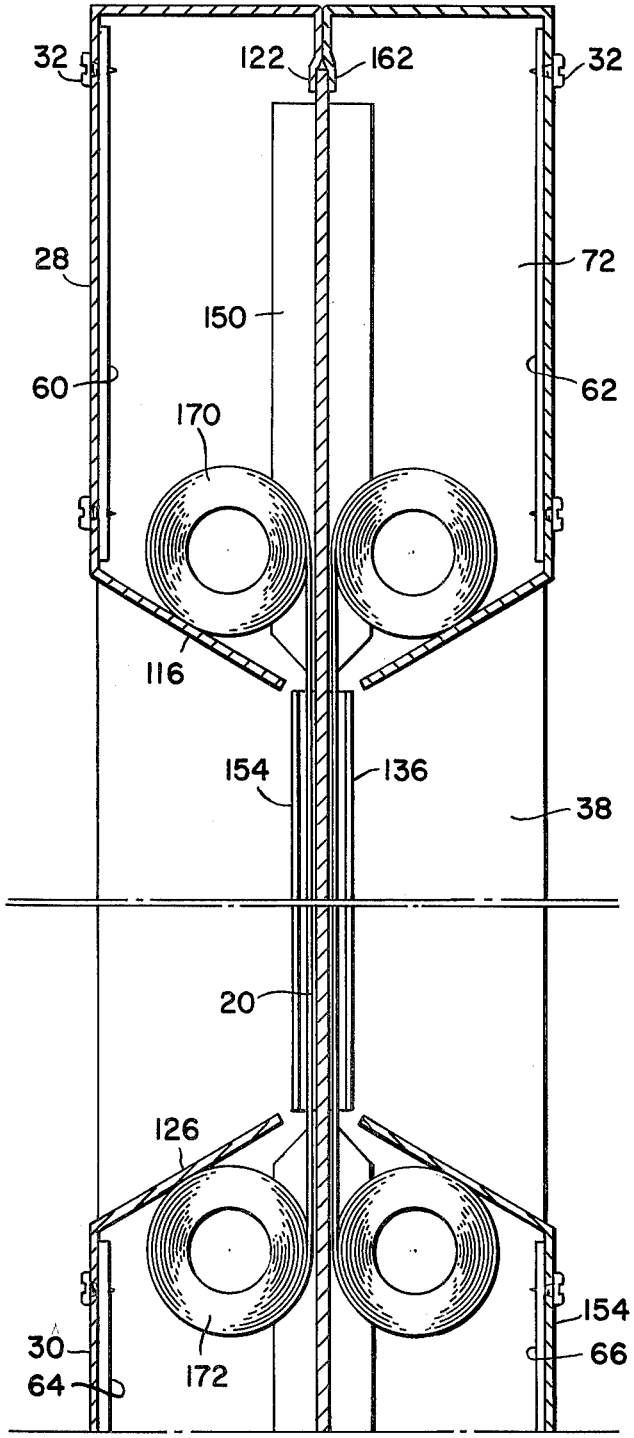
FIG. 10 is a detailed vertical section corresponding the upper portion of FIG. 9, and showing the cooperation of rolls of indicia-carrying material with the roll retainers.

Referring now to FIG. 10, polyester sheet 20 is shown extending from an upper roll 170 to a lower roll 172. The upper roll rests on the inside of oblique retaining portion 116 of retainer 28, and the lower roll 172 is located behind intermediate roll retainer 30 and underneath oblique retaining portion 126. Roll 172 may be in contact with portion 126, depending upon its weight and the resilience of the sheet material. At the upper portion of FIG. 10, the relationship between roll 170 and guide flange 150 is shown.

In the operation of the display, in order to change the information displayed, it is merely necessary to push manually on the exposed portions of the polyester sheets in the upward or downward direction, causing the sheets to pass from one roll to the other.

Many variations from the specific embodiment herein described are possible. For example, the invention can be incorporated into a single row display merely by the adoption of a simpler panel structure, and the elimination of the intermediate roll retainers. Likewise, it will be apparent that the flange and guide channel configuration of the panels of the series can be repeated any number of times to provide displays of more than two rows. When this is done, of course additional intermediate roll retainers are provided.

In addition, displays having more than five panels can be readily constructed using panels identical to the ones shown in FIGS. 2 and 3, it being necessary only to provide longer roll retainers.

The entire support for the display (except for fasteners) can be formed from sheet metal, such as sheet aluminum or steel, so that it is possible to manufacture parts for the display very inexpensively. The indicia-carrying material, while preferably polyester sheets, can be made from various alternative materials, including spring steel. As mentioned previously, although it is preferable to provide guidance both for the rolls and the sheet material extending between the rolls, it is possible to guide only the rolls, or only the sheets, while still obtaining acceptable results.

We claim:

1. A support for use in a movable indicia display comprising a series of at least three substantially identical panels arranged in edge-to-edge adjoining relationship in a plane, each panel having a first guide channel formed along one edge and located on one side of the plane and a second guide channel formed along the opposite edge and located on the other side of the plane, the non-adjacent guide channels of adjoining panels facing each other to provide a guide for the opposite edges of indicia-carrying means located therebetween.

2. A support according to claim 1 including guide means, located adjacent the outer edge of one of the end panels of the series, and cooperating with the guide channel formed along the inner edge of said end panel to provide guidance for the opposite edges of an additional indicia-carrying means.

3. A support according to claim 1 including guide means located adjacent the outer edge of each end panel in the series and cooperating with the guide channel formed along the inner edge of its adjacent end panel to provide guidance for the opposite edges of an additional indicia-carrying means.

4. A support according to claim 1 including guide means located adjacent the outer edge of each end panel in the series and cooperating with the guide channel formed along the inner edge of its adjacent end panel to provide guidance for the opposite edges of an additional indicia-carrying means, and also including retaining means adapted to support rolls of indicia-carrying material, said retaining means extending across said series of panels, being secured to said guide means, and serving to hold said guide means in fixed relationship to each other.

5. A support according to claim 1 wherein the series of panels is substantially rectangular and has an edge perpendicular to the direction of said guide channels and comprising one edge of each of the panels in the series, and having first and second retaining means located along and adjacent said edge of said series on opposite sides of said plane, said retaining means being adapted to support rolls of indicia-carrying material, and the ends of said panels at said edge of said series being clamped between said first and second retaining means.

6. A support according to claim 1 wherein the series of panels is substantially rectangular and has a pair of opposite edges extending parallel to each other and perpendicular to the direction of said guide channels, each of said opposite edges of the series comprising one edge of each of the panels in the series, and having first and second retaining means located along and adjacent one of said edges of the series on opposite sides of said plane, and third and fourth retaining means located along and adjacent the other of said edges of the series on opposite sides of said plane, said retaining means being adapted to support rolls of indicia-carrying material, the ends of the panels along said one of the edges of the series being clamped between the first and second retaining means, and the ends of the panels along said other of the edges of the series being clamped between said third and fourth retaining means.

7. A support according to claim 6 including guide means located adjacent the outer edge of each end panel in the series and cooperating with the guide channel formed along the inner edge of its adjacent end panel to provide guidance for the opposite edges of an additional indicia-carrying means, and wherein each of said retaining means is secured to both of said guide means and said retaining means secure said guide means in fixed relationship to each other.

8. A support for use in a movable indicia display comprising a series of at least three substantially identical panels arranged in edge-to-edge adjoining relationship in a plane, each panel having a first flange formed along one edge and extending perpendicularly from said one edge on one side of the plane, and a second flange formed along the opposite edge and extending perpendicularly from said opposite edge on the other side of the plane, the non-adjacent flanges of adjoining panels providing guide means for the opposite ends of rolls of indicia-carrying material located therebetween.

9. A support according to claim 8 including means, located adjacent the outer edge of one of the end panels of the series, and cooperating with the flange formed along the inner edge of said end panel to provide guidance for the opposite ends of an additional roll of indicia-carrying material.

10. A support according to claim 8 including means located adjacent the outer edge of each end panel in the series and cooperating with the flange formed along the inner edge of its adjacent end panel to provide guidance for the opposite ends of an additional roll of indicia-carrying material.

11. A support according to claim 8 including means located adjacent the outer edge of each end panel in the series and cooperating with the flange formed along the inner edge of its adjacent end panel to provide guidance for the opposite ends of an additional roll of indicia-carrying material, and also including retaining means adapted to support rolls of indicia-carrying material, said retaining means extending across said series of panels, being secured to said means located adjacent the outer edge of each end panel, and serving to hold said means located adjacent the outer edge of each end panel in fixed relationship to each other.

12. A support according to claim 8 wherein the series of panels is substantially rectangular and has an edge perpendicular to said flanges and comprising one edge of each of the panels in the series, and having first and second retaining means located along and adjacent said edge of said series on opposite sides of said plane, said retaining means being adapted to support rolls of indicia-carrying material, and the ends of said panels at said edge of said series being clamped between said first and second retaining means.

13. A support according to claim 8 wherein the series of panels is substantially rectangular and has a pair of opposite edges extending parallel to each other and perpendicular to said flanges, each of said opposite edges of the series comprising one edge of each of the panels in the series, and having first and second retaining means located along and adjacent one of said edges of the series on opposite sides of said plane, and third and fourth retaining means located along and adjacent the other of said edges of the series on opposite sides of said plane, said retaining means being adapted to support rolls of indicia-carrying material, the ends of the panels along said one of the edges of the series being clamped between the first and second retaining means, and the ends of the panels along said other of the edges of the series being clamped between said third and fourth retaining means.

14. A support according to claim 13 including means located adjacent the outer edge of each end panel in the series and cooperating with the flange formed along the inner edge of its adjacent end panel to provide guidance for the opposite ends of an additional roll of indicia-carrying material, and wherein each of said retaining means is secured to both of said means located adjacent the outer edge of each end panel and said retaining means secure said means located adjacent the outer edge of each end panel in fixed relationship to each other.

* * * * *